United States Patent [19]

Slator et al.

[11] 3,955,634

[45] May 11, 1976

[54] HYDRAULIC WELL JAR

[75] Inventors: Damon T. Slator; Archie W. Peil; Thomas R. Bishop, all of Houston, Tex.

[73] Assignee: Bowen Tools, Inc., Houston, Tex.

[22] Filed: June 23, 1975

[21] Appl. No.: 589,416

[52] U.S. Cl. ..... 175/297

[51] Int. Cl.[2] ..... E21B 1/10

[58] Field of Search ..... 175/297, 296

[56] References Cited

UNITED STATES PATENTS

| | | | |
|---|---|---|---|
| 2,721,056 | 10/1955 | Storm | 175/297 |
| 3,302,736 | 2/1967 | Kisling | 175/297 |
| 3,399,741 | 9/1968 | Monroe | 175/297 |
| 3,429,389 | 2/1969 | Barrington | 175/297 |
| 3,562,807 | 2/1971 | Slator et al. | 175/297 |
| R23,354 | 4/1951 | Storm | 175/297 |

*Primary Examiner*—James A. Leppink

*Attorney, Agent, or Firm*—Pravel & Wilson

[57] ABSTRACT

A hydraulic jar for applying a jarring blow to an object stuck in a well wherein two separate annular fluid chambers are provided in the jar, with one of the chambers confining a body of operating hydraulic fluid and means for restraining relative longitudinal movement of the jar for developing tension and stretch in the drill string so as to produce the jarring blow, and with the second annular fluid chamber confining a body of heavy lubricating fluid and splined portions and jarring surfaces to isolate foreign particles from the operating fluid chamber to prevent or inhibit internal jamming or sticking during actuation. Because the means disposed in the operating fluid chamber are subjected only to forces developed during the pulling stroke, the operating fluid chamber may have a greater area for the development of greater pull loads at lower hydraulic pressures than prior hydraulic jar.

15 Claims, 15 Drawing Figures

34b
34
12c
20
34c
20f
10b
10c
22c
22a
22b
20i
20h
22

22a
20
20i
22b
34
22
22d
19
22e
22f
A
34d
36f
36g
22g
34f
36
36a 34f
36a
22
36
36d
36b
15
22
22g
15
36c
36e
36h
36g
22g
38a
36j
38
36k
36n
36m
36p

HYDRAULIC WELL JAR

BACKGROUND OF THE INVENTION

The field of this invention is hydraulic jars for applying a jarring blow to an object stuck in a well.

In the past, hydraulic jars have been constructed with inner and outer telescopically arranged tubular elements movable longitudinally relative to each other and forming between them a single fluid chamber confining an operating fluid such as a light-weight oil or other well-known synthetic hydraulic fluid. Disposed within this fluid chamber one of the elements, usually the outer tubular body, is provided with a restricted portion and the other body is provided with a piston assembly which is adapted to move into and out of the restriction. In operation, the tubular elements are moved longitudinally relative to each other causing the piston assembly to move through the restriction with simultaneous restrained passage of the fluid from one side of the piston assembly to the other. The piston assembly movement is thus severely restricted resulting in the development of tension or compression in the operating drill string, depending upon the particular jar construction and direction of relative movement, i.e. upward or downward. As soon as the piston assembly moves out of the restriction, however, the relative movement of the tubular elements is unrestrained and the parts move suddenly to the limit of their relative movement to produce a jarring blow.

Hydraulic jars of this type have been made as two-way jars for jarring in either direction or as one-way jars for jarring in only one direction, usually on the upstroke. See, for example, U.S. Pat. Nos. 2,721,056, Re. 23,354 and 3,562,807.

Additionally, such prior jars have splined portions provided with each tubular body which are adapted for interlocking engagement to impart rotational driving forces from one to the other during normal well drilling operations. The splined portions are conventionally disposed within the operating fluid chamber of the jar so that the operating fluid may impart some lubricating action to reduce friction between the splines during rotational engagement. However, as mentioned hereinbefore, fluids conventionally employed as hydraulic fluids in such jars are light-weight oils or synthetic fluids. These conventionally employed fluids are chosen primarily for operation as hydraulic fluids, not as lubricants, and usually do not impart adequate lubrication to the splines, particularly under the heavy friction produced during normal well drilling operations.

Moreover, the engagement of the splined portions of such jars, particularly during frictional rotational engagement during normal drilling operations, inevitably results in the formation of foreign particulate matter in the form of minute metal particles or shavings which break away from the splines. This foreign particulate matter can cause jamming of the piston assembly in the restriction or otherwise permanently damage the moving parts of the jar and reduce its operational life.

Further, such prior jars usually have been constructed with jarring surfaces adjacent to or in close proximity with the piston assembly. Such construction has been found to be disadvantageous inasmuch as at least a portion of the jarring blow during a jarring operation is imparted to the piston assembly which can result in damage thereto and reduce the operational life of the jar. In addition, many of these jars have the jarring surfaces disposed in the single fluid chamber which can result in minute metal particles breaking off from the surfaces during jarring operations which can jam or damage the piston assembly and other moving parts.

SUMMARY OF THE INVENTION

With the present invention, the above-mentioned problems and disadvantages associated with prior hydraulic jars have been overcome by providing a unique hydraulic jar assembly having two sealed fluid chambers separately formed wherein one of the chambers is adapted for containing an operational hydraulic fluid and has means disposed therein for developing and suddenly releasing tension in the drill string during the upstroke to cause jarring surfaces provided on the tubular bodies to contact each other in a jarring blow. The second annular chamber is adapted to contain therein the jarring surfaces and disposed a heavy-duty special anti-galling lubricating fluid and has means for preventing relative rotational movement of the telescopically related tubular parts while permitting relative longitudinal movement thereof. Any foreign particulate material in the form of minute metal particles chipped from such means and/or jarring surfaces are entrapped in the second fluid chamber to eliminate or inhibit the sticking or jamming of the tension developing means disposed in the separate first fluid chamber. Additionally, the hydraulic fluid chamber has increased volume area as compared to prior jars which enables the development of higher pull loads with correspondingly lower pressures in the chamber.

DESCRIPTION OF THE PREFERRED EMBODIMENTS

Figure 1:
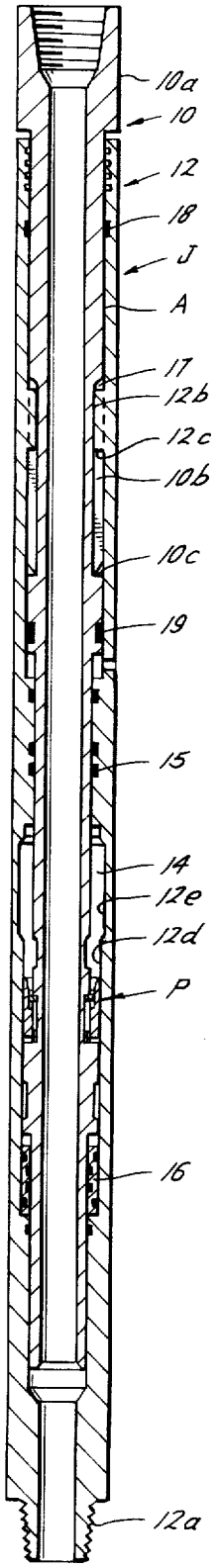
FIG. 1 is a diagrammatic view of the hydraulic jar of this invention in its telescoped or down position.

Referring now to the drawings in greater detail, the hydraulic jar of the present invention, generally designated by the letter J, comprises inner and outer tele scopically arranged tubular elements indicated generally as 10 and 12, respectively, which parts are movable longitudinally relative to each other, and form between them an annular space A. The inner tubular body has an upper end 10a which is threaded or otherwise adapted for connection with a drill pipe or tube string (not shown) or other operating support which normally extends downwardly into a well for the lowering, raising and operation of the jar J. The outer tubular element 12 has a lower end 12a which is threaded or otherwise adapted for connection with a lower section of the drill string and/or any suitable known grapple or the like which may be connected to an object to be jarred in the well such as a stuck pipe or fish.

A first fluid or hydraulic chamber 14 is provided in the annular space A between the inner and outer tubular elements 10, 12 which is defined by a first pair of seal means 15, 16. The seal means 15 and 16 are disposed between the inner and outer tubular elements 10, 12 in a fluid sealing arrangement and are spaced longitudinally relative to each other. The first annular fluid chamber 14 contains a hydraulic fluid, such as a light-weight oil, or like non-compressible synthetic fluid. Further, as more particularly described hereinafter, the hydraulic fluid chamber 14 has means provided with the inner and outer tubular elements disposed therein for developing tension and stretch in the drill pipe string connected to the inner tubular element 10 and sudden release of such tension during upward pulling of the drilling pipe string.

A second annular fluid chamber 17 is also provided between the annular space A between the inner and outer tubular elements 10, 12 which is separate from and spaced longitudinally relative to the first annular fluid chamber 14. The second fluid chamber 17 is defined by a second pair of seal means 18, 19 disposed between the inner and outer tubular elements 10, 12 in sealing engagement therewith and spaced longitudinally relative to each other. The second annular fluid chamber 17 contains a heavy-duty anti-gall lubricating fluid.

Both the inner and outer tubular bodies 10, 12 are provided with splined portions, **10*b* and 12*b*, respectively, which engage each other in a rotational interference fit to transfer rotational driving forces developed during normal drilling operations from one tubular member to the other. Additionally, the inner tubular body 10 has an annular hammer or jarring surface 10*c* which is adapted to hit an anvil or jarring surface 12*c* on the outer tubular body 12 when the bodies 10 and 12** are longitudinally extended with respect to each other during the jarring stroke, as will be more fully explained hereafter.

The splined portions **10*b*, 12*b* and jarring surfaces 10*c*, 12*c* are respectively disposed within the second annular fluid chamber 17 and are thus continuously bathed in the heavy duty anti-gall lubricating fluid contained therein whereby friction developed during movement of the parts relative to each other is greatly reduced, thus increasing the operational life of the hydraulic jar J of this invention. In addition, any minute particles of steel generated from the engagement of the splined portions 10*b*, 12*b* and contacting of the jarring surfaces 10*c*, 12*c* are entrapped in the second annular fluid chamber 17 and prevented from interfering with the tension producing means disposed in the separated first annular hydraulic fluid chamber 14.** Such arrangement substantially eliminates jamming or sticking of the inventive hydraulic jar J during jarring operations.

The above-mentioned means for developing and suddenly releasing tension in the drilling string when it is pulled upwardly for causing the jarring blow disposed in the first hydraulic fluid chamber includes a piston assembly, generally designated as P, on the inner tubular body 10 which is adapted for longitudinal movement through a restricted bore portion **12*d* and an enlarged pressure release bore portion 12*e*, both of which are provided on the outer tubular member 12. The enlarged pressure release bore portion 12*e* is disposed adjacent to the upper end of the restricted bore portion 12*d* and has a greater inner diameter relative thereto. As will be more fully explained hereafter, the piston assembly P serves to provide a restraint during the upward pulling on the inner tubular body 10 relative to the outer tubular body 12 so that tension and stretch develop in the pipe or tubing string connected to the inner tubular body 10 as the piston assembly P moves upwardly through the restriction provided by the restricted bore portion 12*d*. Such tension is produced by the piston assembly P restraining the flow of fluid in the annular chamber 14 from the upper side to the lower side of the piston assembly P as it is pulled upwardly through the restricted bore portion 12*d*. The tension developed is suddenly released when the piston assembly P moves into the enlarged pressure release bore portion 12*e* whereby fluid rapidly escapes around the piston assembly P. The sudden release of the restraint on the piston assembly P and inner tubular body 10 permits the tension and stretch in the drilling pipe string connected to the inner tubular member 10 to exert a rapid and sharp upward movement bringing the jarring surfaces 10*c* and 12*c* into violent jarring contact to thus impart a jarring force through the outer tubular member 12** to the object in the well to be jarred.

Additionally, as will be more fully explained hereafter, after the upward jarring stroke, the drill pipe string and the inner tubular body 10 connected thereto may be lowered relative to the outer tubular body 12 and the piston assembly P is so constructed that there is substantially no restraint or restriction during such downward movement to return the piston assembly P to a position relative to the restricted bore portion **12*d*** for again conducting a jarring stroke.

Both the inner tubular element 10 and the outer tubular element 12 may be formed in one or more sections which are threaded or otherwise coupled together for convenience in manufacture, assembly, repair and the like. As illustrated in FIGS. 3A–3I, the inner tubular part 10 is preferably conveniently made up of an upper mandrel section 20, a lower mandrel extension section 22 and a lower washpipe section 24. Similarly, the outer tubular element is made up of an upper packing retainer section 30, an upper mandrel body section 32, an intermediate mandrel body section 34, an intermediate connector body section 36, a lower pressure body section 38 and a lower washpipe body section 39, all of which have substantially equal external diameters.

The upper mandrel section 20 is partially disposed within and moved longitudinally relative to the upper packing retainer 30, upper mandrel body section 32 and the intermediate mandrel body section 34, and has an upper end portion **20*a* disposed exterior thereto above the upper packing retainer 30. The upper end portion 20*a* has an external diameter substantially the same as the sections of the outer tubular body 12 and is provided with a downwardly facing annular shoulder 20***b* which contacts an upwardly facing annular surface 30*a* provided by the upper end 30*b* of the upper packing retainer section 30 when the inner and outer tubular bodies 10, 12 are in their full telescoped position.

Also an inwardly threaded box 20*c* is provided with the upper end 20*a* for threaded connection with an externally threaded pin of the lower end of a drill pipe section of the drill pipe string (not shown). Similarly, the lower washpipe body section 39 of the outer tubular body 12 has an externally threaded pin 39*a* at its lower end adapted for connection with a box of a lower pipe section of the drilling string or suitable grappling device for connecting to the object to be struck in the well. The upper mandrel section 20 and lower washpipe body section 39 are provided with externally facing annular stress relief grooves 20*d* and 39*b*, respectively, positioned adjacent the respective shoulder 20*b* and pin 39*a*. The annular stress relief grooves 20*d* and 39*b* are of unique design and provide flexing stress relief to the pin 39*a* and shoulder 20*b* of the jar J within the drilling string.

The main body portion 20*e* of the upper mandrel section 20 disposed within the outer tubular part 12 has an outer diameter slightly smaller than the inner diameter of the upper packing retainer section 30, upper mandrel body section 32 and intermediate mandrel body section 34. A plurality of inwardly facing female spline grooves 20*f* are provided on the upper mandrel section 20 which extend longitudinally from about its midportion 20*g* to about its lower end 20*h* to form the above-mentioned splined portion 10*b*. The external diameter of the splined portion 10*b* is slightly less than the upper portion 20*e* to provide a slightly increased annular space with the outer tubular part 12 within the second annular fluid chamber 17 to allow fluid flow of the special anti-galling lubricant therein.

Further, the entire upper mandrel section 20 is of relatively thick-walled construction, preferably of heat-treated steel capable of carrying the entire weight load of the jar J and the drilling string connected thereto and carried therebelow as more fully explained hereafter. The mandrel section lower end 20*h* is externally threaded at 20*i* and connected with the lower mandrel extension upper end 22*a* having internal threads at 22*b*. The lower mandrel extension upper end 22*a* has an outer diameter substantially same as the main body portion 20*e* of the upper mandrel section 20. The lower mandrel extension upper end 22*a* also has an upwardly facing annular surface 22*c* which forms the hammer or jarring surface 10*c* of the inner body 10. Outwardly opening annular external grooves 22*d* and 22*e* are provided on the lower mandrel extension upper end 22*a* within which suitable packing forming the lower seal 19 is received to form a fluid tight seal between the lower mandrel extension upper end 22*a* and the intermediate mandrel body section 34. The lower seal 19 may be of conventional construction such as rubber, teflon or similar packing and, as mentioned hereinbefore, defines the lower end of the second annular lubricating fluid chamber 17. An annular packing ring 22*f* is threadably connected with the lower mandrel extension upper end 22*a* to hold the seal 19 in position for slidable engagement with the intermediate mandrel body section 34 as the tubular parts 10 and 12 move longitudinally relative to each other.

The lower mandrel extension section 22 has a lower portion 22*g* which is of relatively thin-walled construction and has an outer diameter less than the external diameter of the mandrel extension upper end 22*a*. The lower portion 22*g* extends through the intermediate connector body section 36 and lower pressure body section 38 and forms the interior wall of the first annular hydraulic fluid chamber; and has the piston assembly P mounted therewith (FIG. 3G), as will be more fully explained hereafter. The lower end 22*h* of the lower mandrel extension section 22 is externally threaded and connected with the upper end 24*a* of the lower washpipe section 24 which has an outer diameter slightly smaller than the inner diameter of the lower pressure body section 38, with which it slidably engages, and slightly larger than the mandrel extension lower portion 22*g* external diameter.

The lower washpipe section 24 also includes a lower portion 24*b* having an outer diameter substantially same as the outer diameter of the lower mandrel extension lower portion 22*g* which extends longitudinally within the lower pressure body 38 and lower washpipe body section 39 during relative longitudinal movement. An annular floating lower seal 16, preferably is disposed between the lower washpipe section 24 and lower pressure body section 38 which defines the lower end of the first annular hydraulic fluid chamber 14 mentioned hereinabove. The annular floating seal 16 slidably engages the lower washpipe section 24 and lower pressure body section 38 to form a movable fluid tight seal therebetween and is made of conventional construction, preferably having a plurality of outwardly facing and inwardly facing annular grooves 16*a*, 16*b* packed with suitable sealing material 16*c*, 16*d*. The floating seal 16 is adapted for longitudinal movement when the inner tubular part 10 is moved upwardly and downwardly relative to the outer tubular part 12 to prevent excessive pressures in the well from jamming or sticking the piston assembly P in the restricted bore portion 12*d*. More particularly, the floating seal 16 prevents the formation of a vacuum below the piston assembly P as it moves upwardly through the hydraulic fluid in the first annular fluid chamber 14 during a jarring operation. In addition, the floating seal 16 may move longitudinally to equalize pressures within the hydraulic annular chamber 14 relative to pressures within the well.

Referring again to FIG. 3A, the upper packing retainer section 30 is provided with a plurality of inwardly opening annular internal grooves 30*b* within which sealing means such as packers, wipers, etc. and annular rings, indicated at 30*c*, of conventional construction are received to form a slidably engaging fluid tight seal with the upper mandrel section 20 disposed therebetween. The sealing means 30*c*, wipe well fluids from the upper mandrel 20 and otherwise prevent the entry of well fluids into the interior of the hydraulic jar J when the inner tubular member is moved lonngitudinally relative to the outer tubular member 12. The upper packing retainer section 30 is externally threaded adjacent its lower end 30*d* and connected with the internally threaded upper end 32*a* of the upper mandrel body section 32. The upper packing retainer lower end 30*d* has a downwardly facing annular shoulder 30*e* which holds the second annular chamber upper seal 18 in an inwardly opening annular internal groove 32*b* provided with the upper mandrel body section 32 which slidably engages the upper mandrel section 20 to form a fluid tight seal therebetween. As described hereinbefore, the upper seal 18 defines the upper end of the second annular lubricating chamber and may be of any conventional packing. The upper mandrel body section 32 also has an opening 32*c* communicating with the second fluid chamber 17 for filling the chamber with the special anti-gall lubricating fluid. The opening 32*c* is adapted to receive a threaded fill plug 32*d*.

Figure 5:
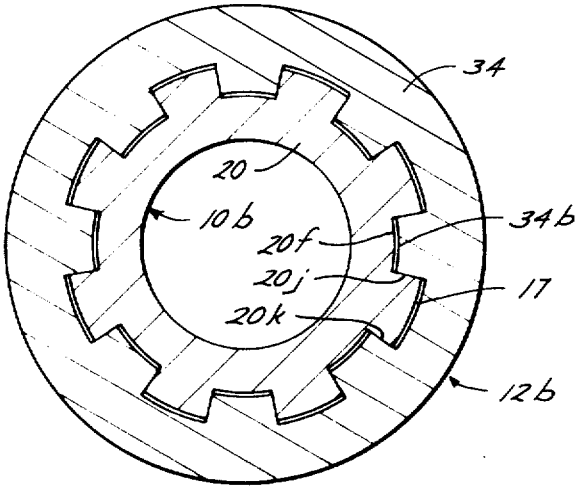
FIG. 5 is a full horizontal cross-sectional view taken along line 5—5 of FIG. 4 illustrating the splined portions of the inventive jar.
Figure 4:
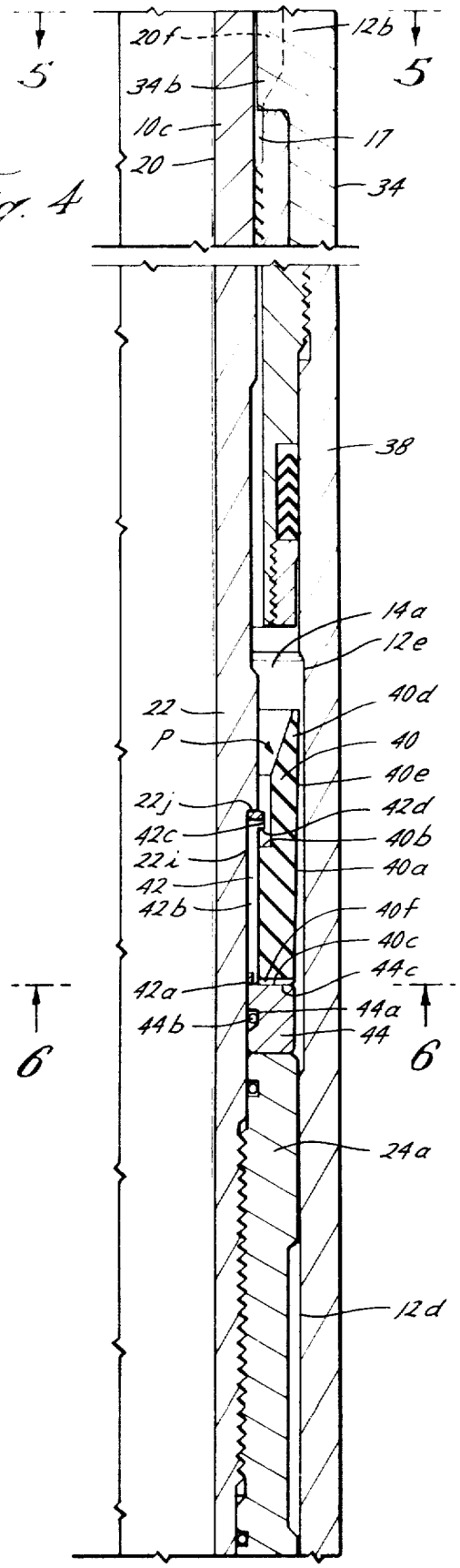
FIG. 4 is an enlarged detailed fragmentary vertical sectional view of one half of the hydraulic jar of FIG. 2, partially cut away, illustrating a portion of the splined portion and part of the lower portion thereof, with the piston assembly disposed in the enlarged bore when the jarring surfaces contact each other causing the jarring blow.

The lower end 32*e* of the upper mandrel body section is internally threaded and connected with the externally threaded upper end 34*a* of the intermediate mandrel body section 34. The intermediate mandrel body section 34 is provided with a plurality of inwardly projecting male splines 34*b* which extend longitudinally forming the outer tubular body splined portion 12*c* and are adapted for positioning in an interference fit within the female splined grooves 20*f*. During normal drilling operations wherein the drilling string in the wall is rotated, rotational driving forces are transmitted through the upper mandrel section 20 to the intermediate mandrel body section 34 by the engagement of the respective male splines 34*b* with the longitudinal female spline grooves surfaces 20*j* or 20*k*, depending on the direction of rotation. (FIG. 5)

Each of the male splines 34*b* have downwardly facing surfaces 34*c* (FIG. 3D) which form the annular anvil or jarring surface 12*d* of the outer tubular member 12. The downwardly facing surfaces 34*c* are thus adapted to come into violent contact with the upwardly facing annular surface 22*c* of the lower mandrel extension 22 during jarring operation.

The intermediate mandrel body section 34 also has an opening 34*d* through its wall disposed below the lower seal 19 on the lower mandrel extension upper end 22*a*. This opening 34*d* functions to prevent bursting of the jar J due to drilling fluids possibly leaking into the annular space A.

The intermediate mandrel body section 34 is internally threaded at its lower end 34*f* and connected with the externally threaded upper end 36*a* of the intermediate connector body section 36 which is provided with internally facing internal grooves 36*b*, 36*c* for receiving packings 36*d*, 36*e* of suitable construction forming the upper seal 15 defining the upper end of the first annular chamber 14 to form a fluid tight seal with sliding engagement with the lower mandrel extension 22. Preferably, a protecting seal 36*f* is provided in an inwardly facing internal annular groove 36*g* disposed at the connector body upper end 34*a* to protect the upper seal 15. Below the seal 15 an opening 36*h* is provided through the wall of the connector body 36 for filling the first annular fluid chamber with a suitable hydraulic fluid. The opening is adapted to receive a seal plug 36*i*, which is preferably of a heavy-duty type to prevent leakage of hydraulic fluid when it is subjected to high pressures developed during the jarring up-stroke.

The connector body is externally threaded adjacent its lower end 36*j* and connected with the internally threaded upper end 38*a* of the lower pressure body section 38. The connector body lower end 38*j* also has an extending portion 38*k* provided with an outwardly facing internal annular groove 36*m* having a suitable packing or seal 36*n* positioned therein and held in position by a threaded annular seal ring 36*p* for forming a fluid tight seal with the lower pressure body section 38 to prevent the leakage of hydraulic fluid from the first annular fluid chamber 14 through the connector body 36 and lower pressure body section 38 threaded connection.

The lower pressure body section 38 forms the exterior annular wall of the first annular hydraulic fluid chamber 14 and is provided with the above-mentioned enlarged pressure release bore portion 12*e* and restricted bore portion 12*d* through which the piston assembly P travels during operation of the jar J. As described more particularly hereafter, the enlarged pressure release bore 12*e* and restricted bore 12*d* combine to form a detent chamber 14*a* of increased volume area between the piston assembly P and the upper seal 15 which provides for the development of high upward pull loads on the drill string at low hydraulic pressures.

The lower pressure body section 38 has the floater seal 16 disposed within its restricted bore portion 12*d* and the lower washpipe section 24 of the inner part 10 as described hereinafter. A second opening 38*b* is provided in the lower pressure body below the piston assembly P when the jar J is in the fully telescoped position for filling the fluid chamber 14 with hydraulic fluid and is adapted to receive a fill plug 38*c*. The fluid chamber 14 is preferably filled with hydraulic fluid by injecting the hydraulic fluid through the opening 38*b* under pressure until fluid exits through the first opening 36*h* in the connector body 36.

Further, the lower end 38*d* of the lower pressure body section 38 is internally threaded and connected with the externally threaded upper end 39*c* of the lower washpipe body section 39 which, as mentioned hereinbefore, is adapted for connection with a lower section of the drilling string and/or grappling devices and the like which are connected to the object to be jarred in the well.

The piston assembly P on the inner tubular part 10 disposed in the fluid hydraulic chamber is substantially similar to the piston assembly described in U.S. Pat. No. 3,562,807, issued Feb. 9, 1971 by D. T. Slator et al., entitled "Hydraulic Jars" which is incorporated herein by reference as if copied in full, with exceptions noted hereafter.

As illustrated in detail in FIGS. 3G, 4, 6 and 7, the piston assembly P includes an annular piston 40 mounted on a by-pass body 42 for limited longitudinal movement relative thereto. The by-pass body 42 may be secured on the inner tubular member 10 and disposed in the first hydraulic fluid chamber 14 in any suitable manner described in U.S. Pat. No. 3,562,807. However, it is preferred that the by-pass body be disposed in an annular recessed portion 22*i* of the lower mandrel extension section 22 and secured thereto between a downwardly facing annular shoulder 22*j* of the recessed portion 22*i* and the threaded upper end 24*a* of the lower washpipe section 24. An annular seal body 44, preferably having an inwardly facing annular groove 44*a* with a suitable annular seal 44*b*, such as an O-ring or other suitable seal means, disposed therein is preferably positioned between the by-pass body lower end 42*a* and the lower washpipe section upper end 24*a*. The seal body 44 with the inwardly facing annular seal 44*b* prevents fluid from flowing below the by-pass body 42 on the inside thereof. Yet, the seal body 44 has a smaller outer diameter than the inner diameter of the outer tubular body restricted portion 12*d* to provide an annular space therebetween for allowing fluid flow without substantial restraint during the pulling and return stroke of the jar J.

The by-pass body 42 is provided with a plurality of longitudinal channels 42*b* which provide for the passage of sufficient volume of fluid from one side of the piston 40 to the other so that there is substantially no restraint on the longitudinal movement of the inner tubular body 10 relative to the outer tubular body 12 when these channels 42*b* are in the open position. The longitudinal channels 42*b* are preferably connected to each other by an annular channel or the like (not shown) to assure even flow of fluid therethrough.

The annular piston 40 has a lower annular portion 40*a* which has an internal diameter slightly larger than the external diameter of the annular by-pass body 42 to provide longitudinal movement of the piston 40 relative thereto. However, the by-pass body 42 is provided with an outwardly extending annular portion 42*c* at its upper end forming a downwardly facing annular shoulder 42*d* which limits the upward travel of the piston 40 with respect to the by-pass body 42 by engagement with an upwardly facing annular shoulder 40*b* that defines the upper end of the piston lower portion 40*a*. The downward travel of the piston is limited by sealing engagement of its lower end 40*c* with the annular seal body upper face 44*c*.

Figure 3A:
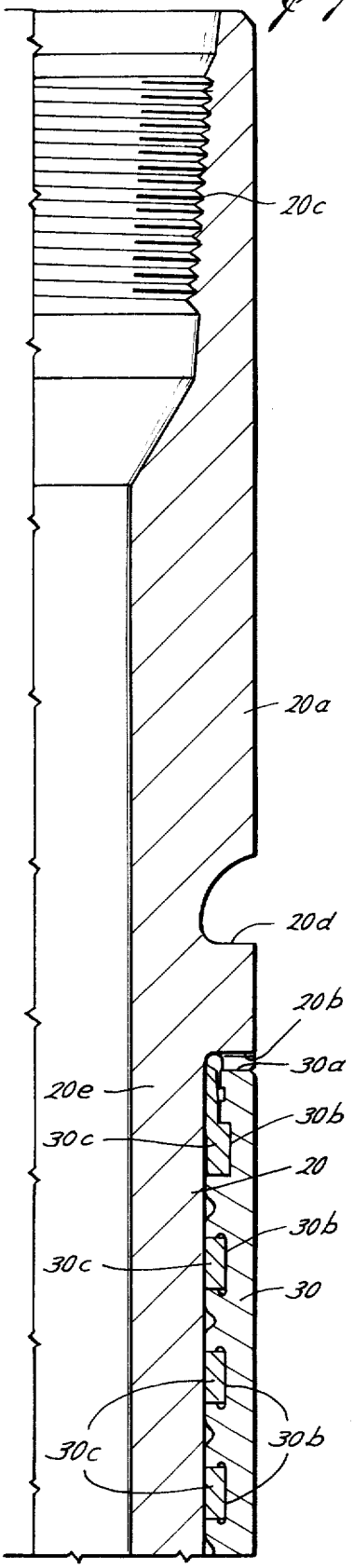
FIGS. 3A, 3B, 3C, 3D, 3E, 3F, 3G, 3H, and 3I are detailed fragmentary vertical sectional views of one half of the hydraulic jar FIG. 1 from substantially the upper portion thereof to the lower portion thereof, and with the piston assembly disposed in position for the upstroke.
Figure 3B:
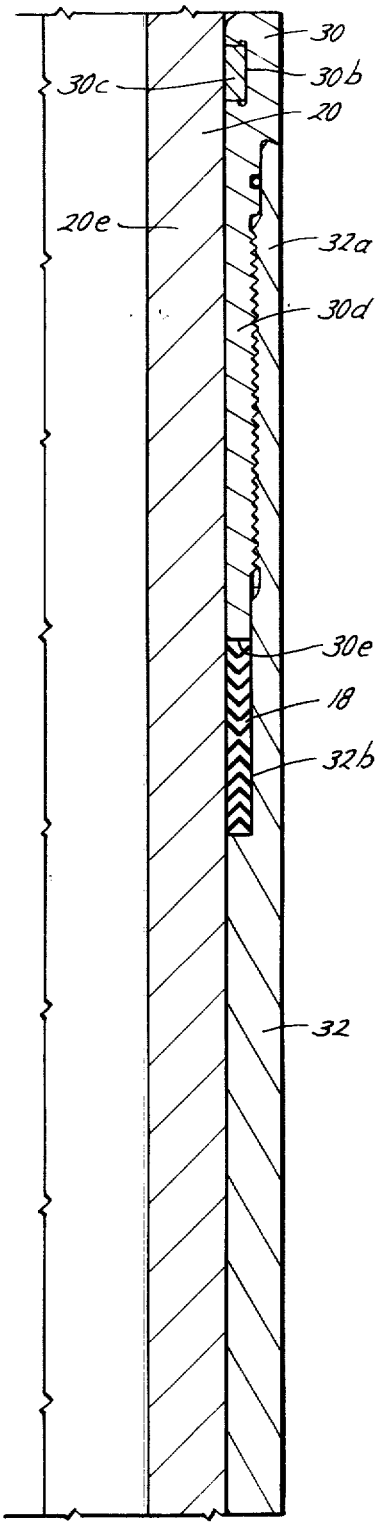
Figure 3C:
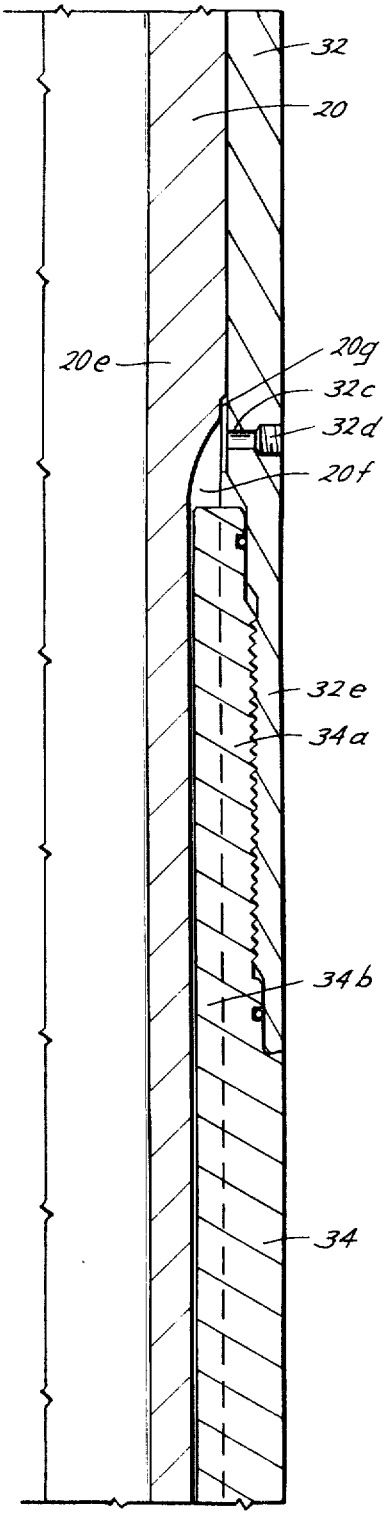
Figures 3D, 3E, 3F:
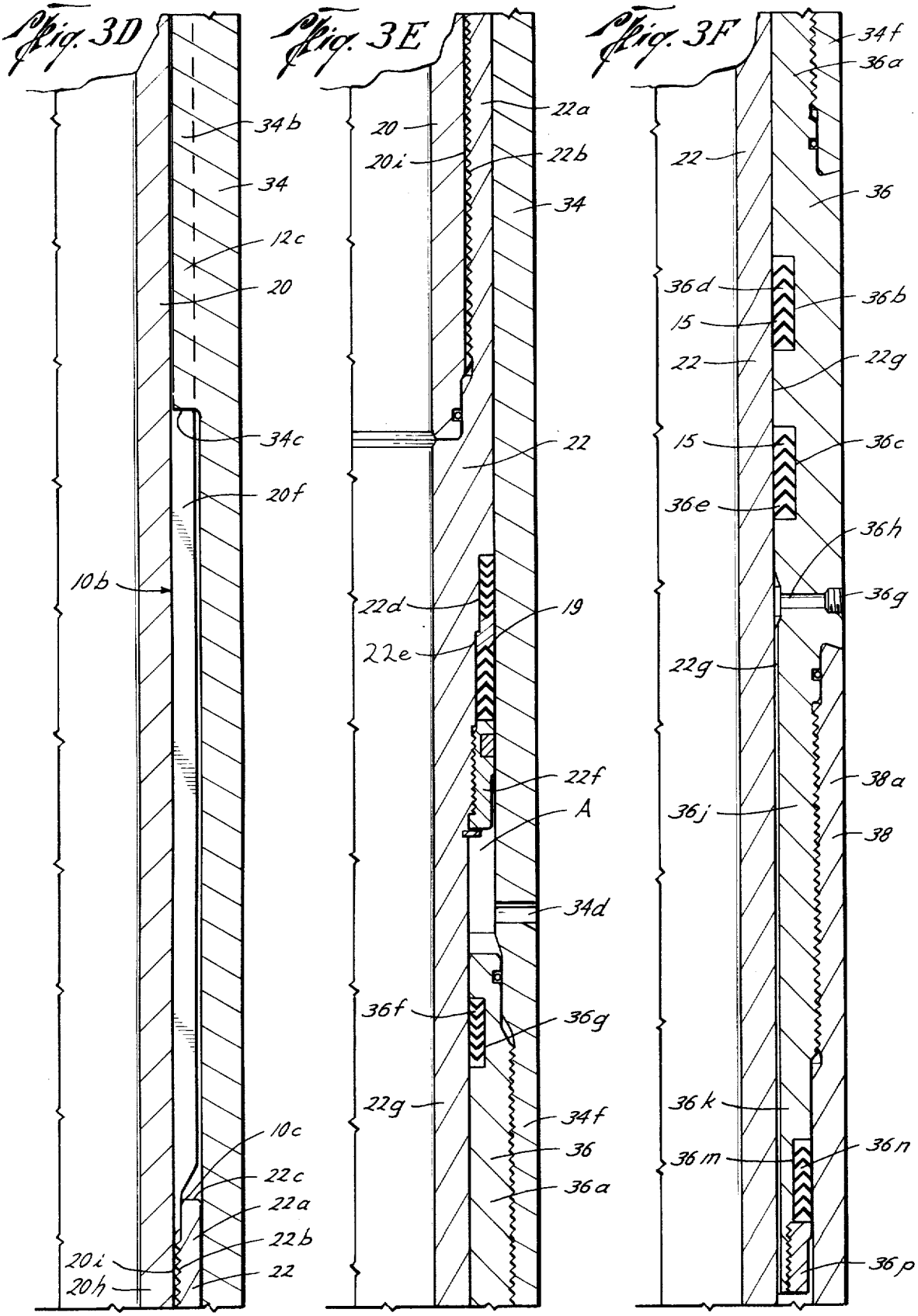
Figure 3G:
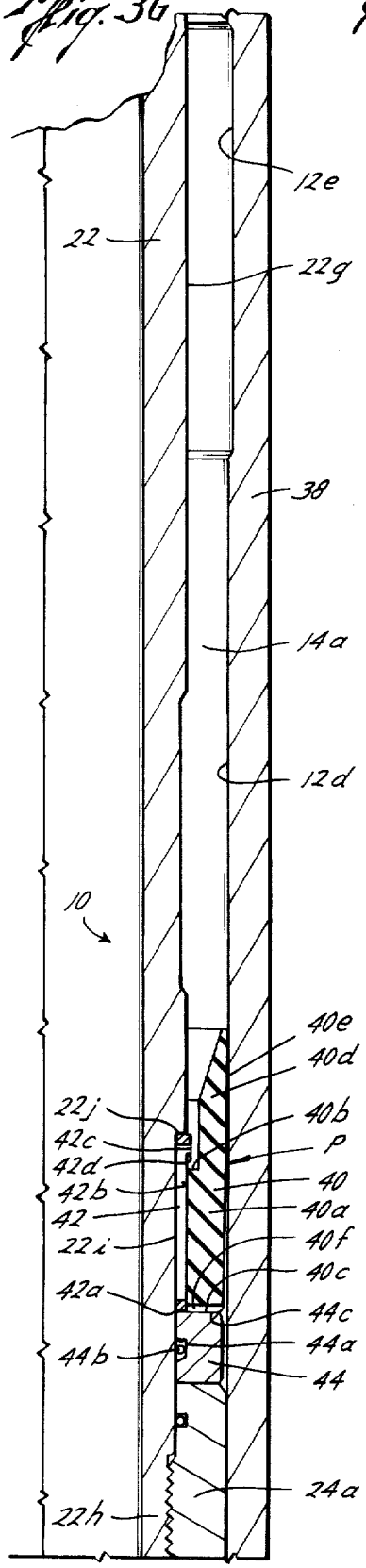
Figure 3H:
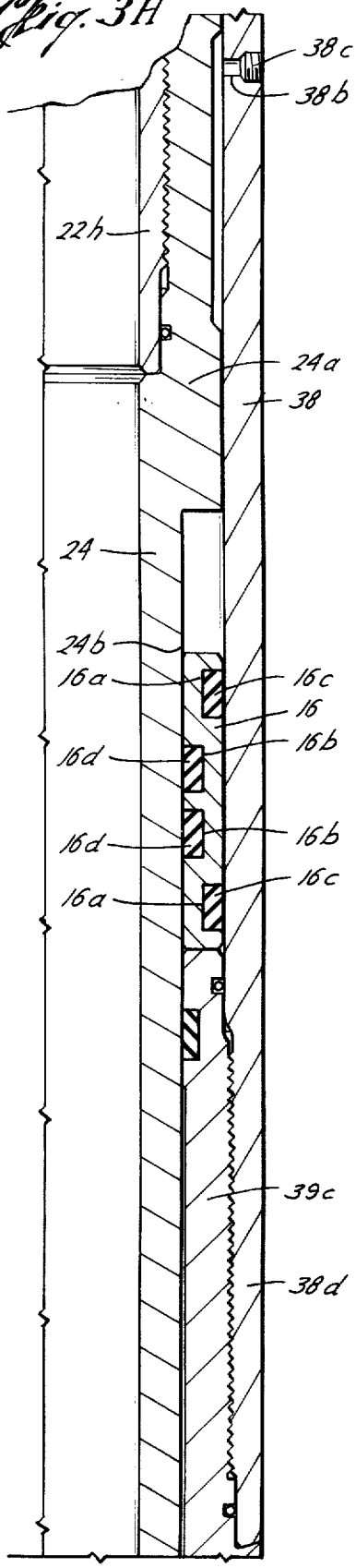
Figure 3I:
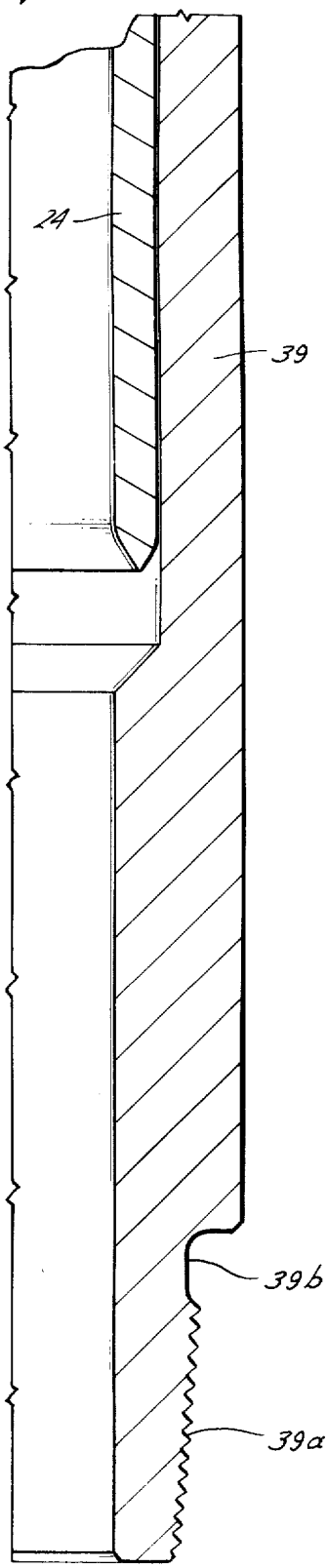

The piston 40 has an annular upper lip portion 40*d* which is flexible and flared upwardly and outwardly. The upper lip portion 40*d* has a highly polished external surface 40*e*, such as highly polished tool steel, that is machined to have an external diameter equal to or slightly greater than the internal diameter of the outer tubular body restricted bore portion 12*d* and is machined for close tolerance metal-to-metal contact therewith. The restricted bore portion 12*d* is also preferably highly polished and made of chrome-plated steel. As illustrated in FIG. 3G, the outer diameter of the piston lower portion 40*a* is slightly smaller than the restricted bore portion 12*d* in a tapered arrangement with the upper lip portion outer surface 40*d* so as to minimize frictional contact between the piston 40 and the restricted bore portion 12*d* while maintaining a metal-to-metal seal therebetween.

Additionally, the flexibility of the upper lip portion 40*d* maintains a non-binding and non-jamming metal-to-metal seal with the restricted bore portion 12*d* even during the upward movement of the inner tubular body 10 relative to the outer tubular body 12 whereby extremely high internal hydraulic pressures are produced above the piston 40 which causes the restricted bore portion 12*d* and upper lip portion 40*d* to expand outwardly. Yet, when extremely high well pressures are experienced which may squeeze the restricted bore portion 12*d* inwardly, the flexible upper lip portion 40*d* may also flex inwardly with the metal-to-metal seal without jamming or sticking.

Figure 6:
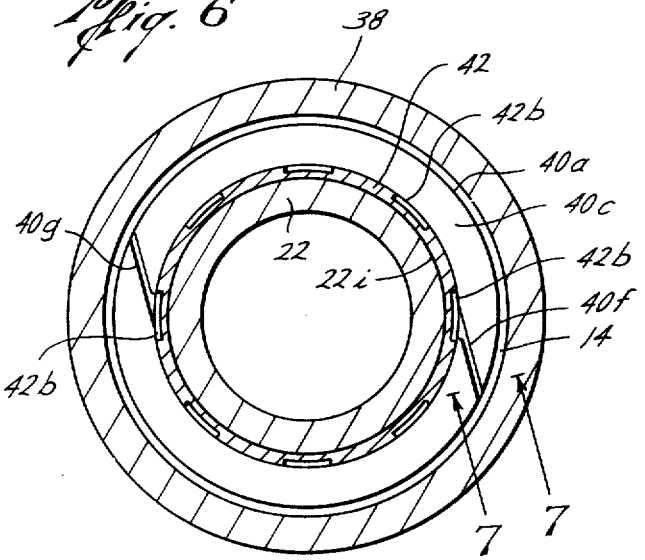
FIG. 6 is a full horizontal cross-sectional view taken along line 6—6 of FIG. 4 illustrating the piston assembly.
Figure 7:
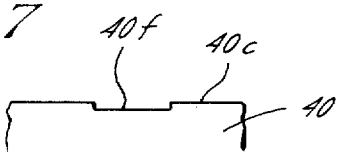
FIG. 7 is a partial vertical cross-sectional view taken along line 7—7 of FIG. 6 illustrating in detail a restricted passageway of the piston assembly of the inventive jar.

As illustrated in FIGS. 6 and 7, the piston is provided with a pair of restricted passages 40*f*, 40*g* disposed on the lower annular piston surface or edge 40*c* which sealably engages the annular seal body upper surface 44*c* when the piston is in its downward position. (FIG. 4) The restricted passages 40*f*, 40*g* provide for the restricted passage of fluid therethrough when the piston is positioned for engagement with the seal body upper surface 44*c* and moved upwardly through the restricted bore portion 12*d* (FIG. 3G). As illustrated in FIG. 6, the restricted bore portions 40*f*, 40*g* extend across the entire width of the piston lower edge 40*c* and are positioned substantially 180° opposite each other at angles relative to the piston radius.

Further, the restricted passages are extremely wide yet extremely shallow and are made to close tolerances so as to block the entry of any foreign particulate matter, such as minute steel particles (mentioned hereinbefore) within the fluid chamber 14 therein which would prevent or diminish the restricted fluid flow therethrough during the up-stroke. More particularly, as illustrated in FIG. 7, the restricted passage ways 40*f*, 40*g* have a very shallow depth, for example only about 0.005 inch and very wide gap or width of approximately 0.050 inch.

Figure 2:
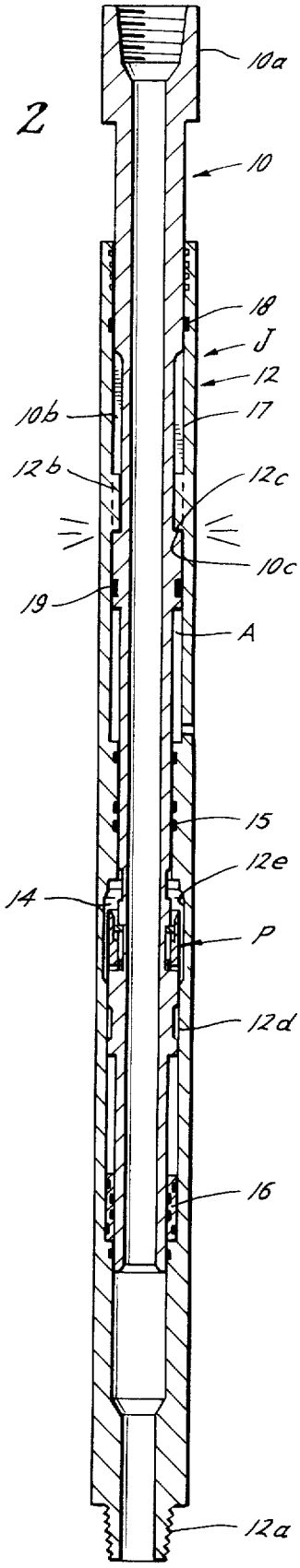
FIG. 2 is a diagrammatic view of the hydraulic jar of this invention similar to FIG. 1 but illustrating it in its uppermost or jarring position.

In the operation or use of the jar of the invention, the lower end 12*a* of the outer tubular member 12 is connected to lower portions of the drill string and/or a grappler or the like which is connected to an object to be jarred in the well. Usually, one or more joints of drill pipe are connected between the grappler device and the outer body lower end 12*a*. The inner tubular element 10 is connected at its upper end 10*a* with the lower end of a drill pipe of the drilling string. Under normal drilling operations, the inner and outer tubular elements 10, 12 are usually in a fully extended position (FIG. 2).

When it is desired to operate the jar J, the driller on the surface initially connected the grappler or like device to the object stuck in the well by conventional techniques and then lowers the drilling string or slacks off to assure the jar J is in its fully telescoped position (FIG. 1). It will be noted that in the fully telescoped position the piston assembly P is positioned within the restricted bore portion 12*d* and the piston 40 is at its lowermost position whereby its lower edge 40*c* is in sealing engagement with the seal body upper surface 44*c*. When it is desired to initiate the jarring stroke with the jar J, the driller pulls upwardly on the drilling string at the surface so as to exert an upward pull on the inner tubular body element 10. Inasmuch as the outer tubular body 12 is connected by the abovementioned conventional grappling device to the stuck object to be jarred in the well, it remains substantially immobile. As the inner tubular element 10 begins to move upwardly, the fluid above the piston 40 within the annular hydraulic fluid chamber is forced through the by-pass body longitudinal passages 42*b* and then through the restricted passages 40*f*, 40*g*. Due to the above-mentioned restricted size of the restricted passages 40*f*, 40*g*, the fluid pressure above the piston 40 increases rapidly thereby restraining the movement of the inner tubular body 10. The restraint increases while the fluid slowly passes through the restricted passage ways 40*f*, 40*g* which causes the drilling string to stretch and develop a tremendous amount of tension therein. Tension and stretch continues to increase until the piston upper lip portion 40*d* reaches the outer tubular element enlarged pressure release bore portion 12*e*. When that occurs, there is a sudden release of the restraint by the free flow of the fluid around the piston 40 which allows the inner tubular body 10 and the drilling string connected thereto to move upwardly rapidly as the tension and stretch in the string is released, causing the jarring surfaces 10*c*, 12*c* to contact each other with a violent jarring blow.

Such jarring blow constitutes an upward force which is transmitted to the outer tubular element 12 and thus through the lower connections of the drilling string to the object to be jarred. If such jarring blow does not immediately release the stuck object, the drilling string is then slacked off or lowered again whereby the inner tubular body moves downwardly relative to the outer tubular element 12. During this downward movement, the piston 40 is caused to move upwardly relative to the by-pass body until the lower portion upper annular surface 40*b* engages the by-pass body annular extension 42*d* which allows the fluid within the first annular fluid chamber 14 to flow freely from below the piston 40 through the by-pass channels 42*a* thereby allowing the innner tubular body 10 to move downwardly to a fully telescoped relation substantially unrestrained.

As described hereinbefore, the jarring surfaces 10*c*, 12*c* of the respectiive inner and outer tubular elements of the inventive jar J are disposed in the second annular fluid chamber 17 completely separate from the first annular fluid chamber 14 and the piston assembly P disposed therein. Such arrangement allows the jarring forces and all forces developed during normal drilling operations to be transmitted through the relatively thick-walled upper mandrel section 20 and lower mandrel extension section upper end 22*a* of the inner tubular member 10 and through the relatively thickwalled outer tubular element 12. Such arrangement allows the lower mandrel extension section lower portion 22*g* and the lower washpipe section 24 of the inner tubular body 10 to be made of relatively thin-walled construction inasmuch as such members are subjected only to pressure loads developed during jarring operations. Such construction further provides for the use of an upper seal 15 for the annular hydraulic fluid chamber 14 which has an inner diameter that is substantially smaller than the outer diameter of the piston 40. The annular space between the annular piston 40 and upper seal 14 thus forms a detent chamber 14*a* of relatively large volume area which is larger than the volume area of prior art jars which provides for the development of greater pull loads and tension in the drilling string at lower hydraulic pressures during the performing of a jarring stroke which increases the operational life of the hydraulic jar of the present invention.

Moreover, the hydraulic jar of the present invention allows the driller to develop and employ increased pull loads for intense jarring forces. For example, if desirable, the driller may slack off on the drilling string and move the inner tubular body to only a partially telescoped position relative to the outer tubular body 12 and then begin the upward pull on the drilling string whereby the piston moves only partially through its designed travel within the restricted bore portion 12*d* thereby developing a lower pull load and tension within the drilling string connected to the inner tubular element 10. Alternatively, the driller may elect to employ a lower upward pull load whereby lower pressures are developed in the detent chamber 14*a* between the piston 40 and the upper seal 15 in the annular chamber 14.

The foregoing disclosure and description of the invention are illustrative and explanatory thereof, and various changes in the size and shape as well as the details of the illustrative construction may be made without departing from the spirit and scope of the invention.

We claim as our invention:

1. A hydraulic jar tool comprising:

inner and outer telescopically related tubular elements movable longitudinally relative to each other;

means for connecting one of said elements to a drill pipe string;

means for connecting the other element to an object to be jarred in a well;

jarring surfaces on said tubular elements for jarring contact with each other;

said inner and outer tubular elements having telescopically overlapping portions providing an annular space therebetween;

a first pair of annular seal means disposed between said tubular elements and longitudinally spaced relative to each other for forming a first annular fluid chamber for confining a hydraulic operating fluid;

fluid restriction means in said first annular fluid chamber for resisting relative longitudinal movement of said tubular elements to an extended position;

means for releasing said fluid restriction means after a predetermined relative movement between said tubular elements for subsequent unrestrained relative movement therebetween until said jarring surfaces engage each other;

a second pair of annular seal means disposed between said tubular elements and longitudinally spaced relative to each other for forming a second annular fluid chamber separate from said first annular fluid chamber for confining a lubricating fluid; and rotation means in said second annular fluid chamber for imparting a rotational driving force from the tubular element to the other tubular element and for preventing relative rotational movement while permitting relative longitudinal movement between said tubular elements.

2. The hydraulic jar of claim 1 wherein:

said jarring surfaces on said tubular elements are disposed in said second annular fluid chamber whereby said jarring blow caused by said forcible contact of said jarring surfaces is transmitted from the inner tubular element to said outer tubular element.

3. The hydraulic jar of claim 1 wherein said rotational means includes:

splined portions provided on said tubular elements which are relatively thick-walled, said splined portions longitudinally slidably engaging each other in interlocking fit to prevent relative rotational movement and to permit relative longitudinal movement between said tubular members; and said inner tubular element is further provided with a relatively thin-walled portion having an outer diameter smaller than the outer diameter of said splined portion, said thin-walled portion having said piston assembly thereon and forming an inner wall of said first annular fluid chamber.

4. The hydraulic jar of claim 3 wherein:

said jarring surfaces on said tubular elements are disposed in said second annular fluid chamber, said jarring surfaces being provided by an upwardly facing annular contact surface adjacent one end of said inner tubular element splined portion and a downwardly facing annular contact surface adjacent one end of said outer tubular element splined portion whereby said jarring blow caused by the forcible contact of said contact surface is transmitted from the relatively thick-walled inner tubular element splined portion to the outer tubular element which is imparted to the object to be jarred.

5. The hydraulic jar of claim 1 wherein said second pair of annular seal means include:

an upper annular seal supported on one of said tubular elements and slidably engaging the other element, to form a fluid tight seal therebetween, a lower annular seal supported on one of said tubular elements and slidably engaging the other element to form a fluid tight seal therebetween;

said annular seals being longitudinally spaced above and below said splined portions and jarring surfaces to define and isolate said second annular fluid chamber between the outer and inner tubular elements for confining a lubricating fluid in said second annular chamber for reducing friction between movable parts disposed therein.

6. The hydraulic jar of claim 1 wherein said first pair of annular seal means include an upper annular seal supported on one of said tubular elements slidably engaging the other of said elements to form a fluid tight seal therebetween, a lower annular seal disposed between and slidably engaging both of said tubular elements to form a fluid tight seal therebetween, said seals being longitudinally spaced relative to each other and having said restricted and pressure release bores of said outer tubular element and the piston assembly on said inner tubular element positioned therebetween to define and isolate said first annular fluid chamber between said tubular elements which is substantially unaffected by change in the fluid pressure of the well fluid in which the jar is operated.

7. The hydraulic jar of claim 1 wherein the fluid restriction means includes a restricted bore portion provided on said outer tubular element forming a restriction in the first annular fluid chamber, and a piston assembly on the inner tubular element adapted to be moved in said restriction upon relative longitudinal movement of said tubular elements, said piston assembly including means for restricting fluid flow from an upper side of said piston assembly to a lower side thereof when said piston assembly is moved upwardly through said restriction to develop a high pull load on said inner tubular element, and means for allowing substantially free fluid flow from said lower side to said upper side of said piston assembly when said piston assembly is moved downwardly through said passageways to provide substantially unrestrained movement of said tubular elements to a telescopical position.

8. The hydraulic jar of claim 7 wherein the means for releasing said fluid restriction means includes:

an enlarged bore portion provided on said outer tubular element and disposed adjacent said restricted bore portion, said enlarged bore portion having an inner diameter greater than the inner diameter of said restricted bore portion and outer diameter of the piston assembly to provide substantially free fluid flow around said piston assembly when said piston assembly is moved upwardly therethrough.

9. The hydraulic jar of claim 8 wherein:

said inner tubular element is provided with a relatively thick-walled portion disposed between said second pair of seal means forming an inner wall of said second annular fluid chamber, and a relatively thin-walled portion disposed between said first pair of annular seal means forming an inner wall of said second annular fluid chamber, said thin-walled portion having an outer diameter smaller than the relatively thick-walled portion outer diameter.

10. The hydraulic jar of claim 9 wherein:

said piston assembly includes an annular piston having an outer diameter substantially equal to the inner diameter of said outer tubular element restricted bore portion and with a flexible metal-to-metal contact therebetween, said first pair of annular seals include an upper annular seal supported on the outer tubular element slidably engaging said inner tubular element thin-walled portion and having an inner diameter substantially equal to the outer diameter of said thin-walled portion which is smaller than the outer diameter of said annular piston, said upper annular seal and said annular piston defining a high pressure zone in said first annular chamber as the piston assembly is moved upwardly in the restricted bore, said zone having increased volume area to permit the utilization of high pull loads on said inner tubular element with the development of low hydraulic pressures in said high pressure zone to develop high jarring blow forces with said low hydraulic pressures when said jarring surfaces are caused to contact each other.

11. The hydraulic jar of claim 9 wherein said piston assembly includes:

a substantially annular piston having an upper lip with an external diameter substantially the same as the inside diameter of said restricted bore and with a flexible metal-to-metal sealing contact therebetween;

an annular by-pass body;

said piston being movable relative to said inner tubular element to a position for freely by-passing fluid around said piston during a return stroke of the jar due to contact between said lip and said restricted bore;

said piston being movable downwardly relative to said inner tubular element to a pulling or jarring position due to contact between said lip and said restricted bore;

means restricting fluid flow in said first annular fluid chamber around said piston during the pulling or jarring stroke; and said lip being flared outwardly and being flexible for maintaining the metal-to-metal sealing contact with said restricted bore.

12. The hydraulic jar of claim 11 wherein said means restricting flow around said piston includes at least one restricted passage formed as a part of said piston.

13. The hydraulic jar of claim 12 wherein:

said by-pass body has an upper stop means therewith adapted to be engaged by said piston as said piston is moved downwardly in said restricted bore;

said by-pass body having a by-pass means from the upper end of said piston inwardly thereof to the lower end of said piston when said piston is in engagement with said upper stop means to provide for the unrestricted by-pass of fluid around said piston during the return movement of the piston;

means disposed adjacent said by-pass body for providing a lower stop surface engageable by said piston during the pulling stroke for forming a seal therebetween so that fluid above the piston is forced through the restricted passage into the area below the piston to provide a restraint on the upward movement of the inner tubular body until said piston has moved from said restricted bore to said pressure release bore portion of said outer tubular element.

14. The hydraulic jar of claim 13 wherein:

said restricted passage is formed on a lower annular face of said piston engageable with the means for providing said lower stop surface, said restricted passage being formed to prevent blockage by or entry of foreign particulate matter by being angled from the radius of said annular piston and having a narrow depth with relatively wide width from said piston lower annular surface.

15. The hydraulic jar of claim 14 wherein said piston has at least two of said restricted passages formed on said lower annular surface.

* * * * *